United States Patent [19]

Hobbs

[11] Patent Number: 4,530,420

[45] Date of Patent: Jul. 23, 1985

[54] LEG PROTECTOR AND SOCKET FOR CLIMBERS

[76] Inventor: Edwin L. Hobbs, 10 Lance Ct., Moraga, Calif. 94556

[21] Appl. No.: 646,895

[22] Filed: Aug. 31, 1984

[51] Int. Cl.[3] ..... A63B 27/02

[52] U.S. Cl. ..... 182/221; 182/134

[58] Field of Search ..... 182/221, 134, 135

[56] References Cited

U.S. PATENT DOCUMENTS

| | | | |
|---|---|---|---|
| 1,026,853 | 5/1912 | Donnelly | 182/221 |
| 1,505,360 | 8/1924 | Lowery | 182/134 |
| 1,727,237 | 9/1929 | Katz | 182/221 |
| 2,016,249 | 10/1935 | Bashlin | 182/221 |
| 2,297,136 | 9/1942 | Detering | 182/221 |
| 2,391,810 | 12/1945 | Webber | 182/221 |
| 2,604,250 | 7/1952 | Trimble | 182/221 |
| 2,760,705 | 8/1956 | McIntire | 182/221 |
| 2,835,426 | 5/1958 | Terry | 182/221 |
| 3,297,105 | 1/1967 | Lawrence | 182/46 |
| 3,640,358 | 2/1972 | Smith | 182/221 |
| 3,867,998 | 2/1975 | Joseph | 182/221 |
| 4,153,139 | 5/1979 | Houch | 182/221 |

OTHER PUBLICATIONS

Bishop Company Catalog, Exhibit B.

*Primary Examiner*—Reinaldo P. Machado
*Attorney, Agent, or Firm*—James R. Cypher

[57] ABSTRACT

An improved tree and pole climber consisting of an inflexible socket member connected to a foam pad member which is designed to receive the shank portions of most commercial tree climbers. The socket member is formed so that the shank of the tree climber can rotate axially, can pivot forwardly and rearwardly in a plane at right angles to the stirrup of the climber and can pivot outwardly from the leg of the climber. The movement of the shank in the inflexible socket permits freedom of movement of the foot and thereby maximizes comfort in wearing the climber and minimizes chafing and injury to the leg of the workperson.

5 Claims, 6 Drawing Figures

LEG PROTECTOR AND SOCKET FOR CLIMBERS

BACKGROUND OF THE INVENTION

This invention relates to a climber to be used by professional utility polemen, lumberjacks and tree trimmers for climbing trees and wood poles.

Climbers as used by professionals consist of a stirrup which supports the instep of the user, a shank which is connected to the stirrup which is thrust into the tree or pole. A pad for protecting the leg is connected to the upper end of the shank. The shank also provides vertical stability to the gaff and for this reason, the shank must be attached to the inner side of the leg. The prior art assumed that vertical stability of the shaft was required for safety and that the upper end of the shank should be as rigidly attached to the pad as possible.

Holding the shank rigid is certainly desirable for climbing but the problem arises when the workman must set the gaffs into the tree or pole and then stand on the stirrups for long periods of time while he accomplishes his work. The shaft rigidly attached to the leg serves as a non-yielding cast and ignores the fact that as the workman bends, leans, stretches, etc., he moves his leg relative to the foot about the ankle. When the workman moves his foot on the stirrup, the leg moves in relation to the stirrup and shank and something has to give. With the state-of-the-art climbers in which the shaft is rigidly attached to the pads, it is the pad that moves in relation to the calf of the leg and this movement causes a chafting of the leg. While chafing can be tollerated for a short time, persistent chafing day after day can cause serious discomfort and even injury to the leg. Prolonged chafing can make wearing climbers so uncomfortable that the workmen cannot wear the climbers until the leg heals.

Leather pads which attempt to prevent injury are shown in Katz, U.S. Pat. No. 1,727,237 (1929); Smith U.S. Pat. No. 3,640,358 (1972) and Joseph U.S. Pat. No. 3,867,998 (1975). Chafing is a problem with these leather pads.

Attempts to rigidize the leather pads by facing them with metal and rigidly attaching the shafts to the metal are taught by Detering U.S. Pat. No. 2,297,136 (1942) and McIntire U.S. Pat. No. 2,760,705 (1983). Again, chafing is a problem even though it is somewhat lessened by the addition of felt and sponge.

SUMMARY OF THE INVENTION

The gist of the present invention is the provision of a leg attachment member which provides substantial controlled movement between the shank and a non-yielding socket which is attached to a yieldable pad. The leg attachment pad partially envelopes the leg and is held to the leg by strap means. The non-yielding socket permits near universal movement of the top of the shank yet provides rigid limits to that movement.

The primary objective is to provide a leg attachment for a climber which permits safe climbing of trees and poles in comfort and without chafing and injury to the leg.

Another object is to provide a leg attachment which will accept all of the widely commercially available shanks used in climbers.

A further object is to provide metal to metal contact between the metal or non-yielding shank and the metal or non-yielding socket of the leg member to provide positive solid climbing characteristics yet permit the user to move his leg while standing on the climber stirrups for long periods of time.

A still further object is to provide the above without adding substantial weight or complexity to the climber.

Still another object is to provide a climber with the above characteristics which is rugged and long lasting and requires minimum maintenance.

DESCRIPTION OF THE PREFERRED EMBODIMENT

Figure 1:
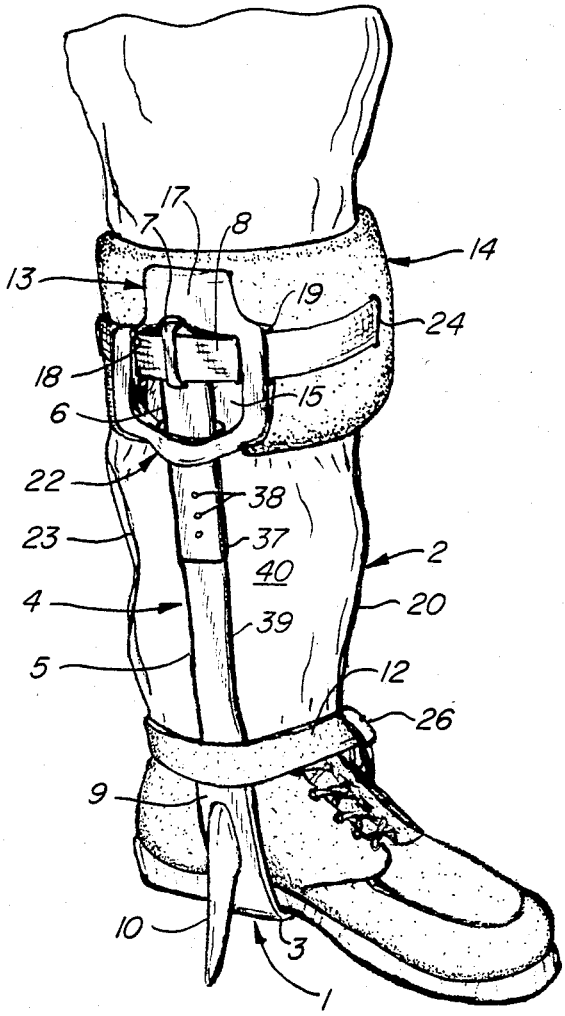
FIG. 1 is a perspective view of the leg attachment member of the present invention attached to a standard shank, gaff and stirrup of a climber. The entire climber is shown attached to the inside of the leg of the user.
Figure 3:
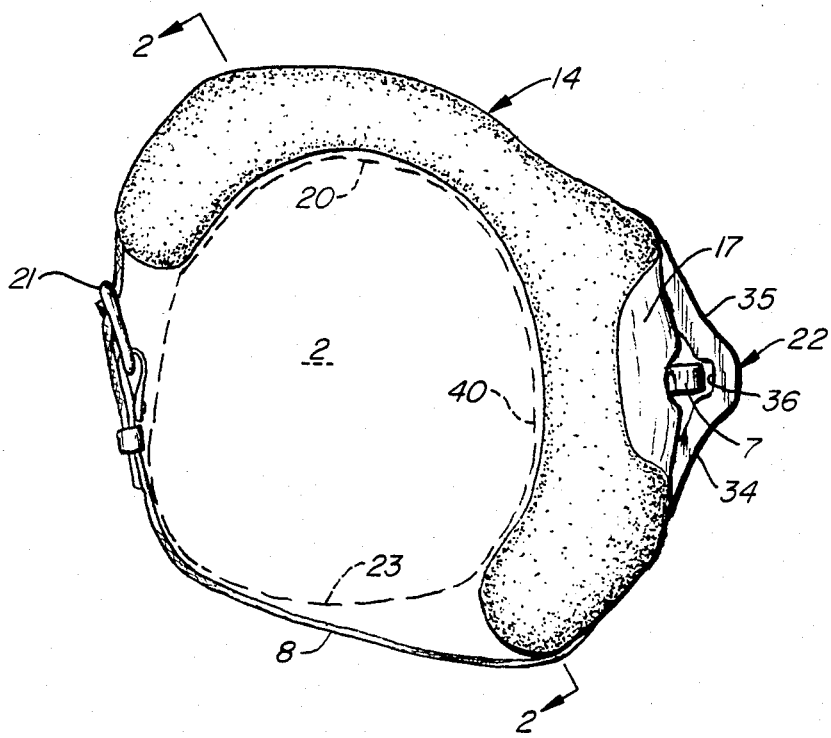
FIG. 3 is a top view of the device shown in FIG. 1 with the leg of the user in phantom.

The climber 1 which is worn on the leg 2 of a workperson such as an electric utility poleman, lumberjack or tree trimmer consists of a stirrup member 3 adapted for receipt of the instep of the shoe of the user. The climber is always used in pairs and is strapped to the inside of the user's leg. FIG. 1 shows the climber attached to the left leg. For brevity, only one climber will be described. A shank member 4 is connected to the stirrup member at a generally right angle and includes an elongated member 5, an upper end 6 having a loop member 7 attached thereto adapted for receiving a strap member 8 and a lower end member 9.

A gaff member 10 is connected to the lower end of the shank and is adapted for piercing a wood pole or tree. The gaff is angled slightly outwardly from the side of the shank. The stirrup, shank and gaff members are commercially available from several different manufactures. The end of the stirrup is formed with a loop 11 through which a foot strap 12 is threaded.

The improvement of the present invention is a rigid socket member 13 connected to a flexible pad 14. The socket member consists of a base member 15, an end member 16 which projects from the base member and an upper holding member 17 spaced from the base member. A pair of openings 18 and 19 are formed in the socket member on either side of the upper holding member and spaced below the upper holding member. The openings are dimensioned for receiving the leg strap 8 which carries a buckle 21. A lower holding member 22 is formed on the lower end of the base member.

The flexible pad member 14 is connected to the rigid socket member by means of fasteners or preferably an adhesive. The pad member may be formed from a plastic foam closed cell polyurethane to generally conform to the leg. Any suitable rubber or plastic which is elastic, does not absorb water and does not take a permanent set under normal use may be used. Preferably, the pad should be molded so that it encapsulates the front 20 of the leg and a portion of the back 23 of the leg. Since the climber is worn on the inside 40 of each leg, the pad portion for the right and left leg are not interchangeable and the right pad will be a mirror image of the left pad shown.

The pad 14 should have sufficient thickness so that it acts as a shock absorber. In other words, as the shank transmits force to the rigid socket member, the load will be absorbed in the foam pad and distributed over a large portion of the leg in contact with the pad. The pad must then return to its original shape and position after the load is withdrawn. The pad must have sufficient thickness so that the smaller inflexible socket will not bear upon the user's leg. The pad should be approximately 1 to 1½ inches thick.

Preferably the foam pad member is formed with passage 24 through which strap 8 is threaded. The passage prevents separation of the strap from the flexible pad and holds the end of the strap in position for putting on the climber.

Foot strap 12 is formed with a buckle 26 and wraps over the top of the foot and around the outside of the shank at about ankle height. Foot strap 12 holds the foot in the stirrup and assists in positioning the gaff in relation to the foot.

The upper holding member 17 and the lower holding member 22 are spaced from the base member a distance greater than the thickness of the shank member permitting limited axial rotation of the shank within the socket member. Axial rotation may vary from about 15 to 20 degrees in either direction from the plane of the base member of the socket member. This rotation is shown by the double arrow 27 in FIG. 6.

Figure 5:
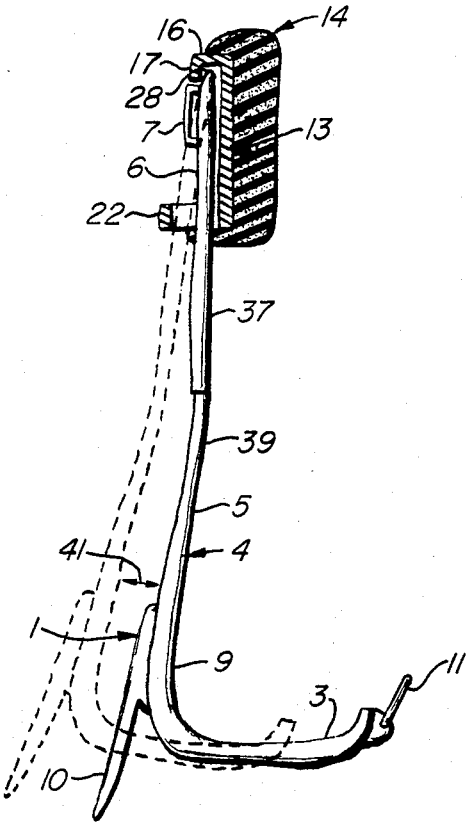
FIG. 5 is a front cross sectional view of the device taken along line 5—5 of FIG. 4. The shank and gaff are shown in phantom line showing the range of lateral pivotal movement of the shank and gaff with respect to the socket member.

Referring to FIG. 5, it may be seen that the shank member 4 is permitted to move laterally through an angle shown by double arrow 41 to a position approximately shown by the phantom lines. The lateral pivotal movement is permitted by forming the socket member so that the lower holding member 22 is spaced a greater distance from the base of the socket than the upper holding member 17. Lateral pivotal displacement of the shank member 4 occurs about the upper shank edge 28 which serves as a fulcrum.

Figure 4:
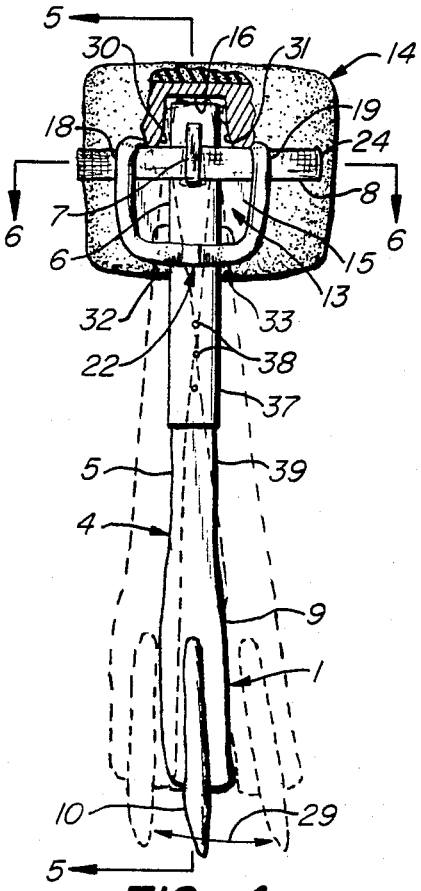
FIG. 4 is a side view of the leg attachment connected to the shank of a climber. The phantom lines show the range of forward and rearward pivotal movement of the shank with respect to the socket member. Portions of the flexible pad and socket member are cut away to more clearly illustrate the range of movement of the upper shank.

Referring to FIG. 4, shank member 4 is also permitted to move through an angle shown by double arrow 29 from front to back about 5 to 8 degrees from the vertical in either front to rearward position. The pivotal movement is made possible by providing a pair of upper side members 30 and 31 which are connected to the socket base and are spaced from one another and connected to the upper holding member 17. In addition, a pair of lower side members 32 and 33 are connected to the socket base and are spaced from one another and are connected to the lower holding member 22. The lower side members are spaced a further distance apart then the upper side members permitting restricted pivotal movement of the shank member about the upper end of the shank member which acts as a fulcrum in a plane generally at right angles to the plane of the stirrup member.

Figure 6:
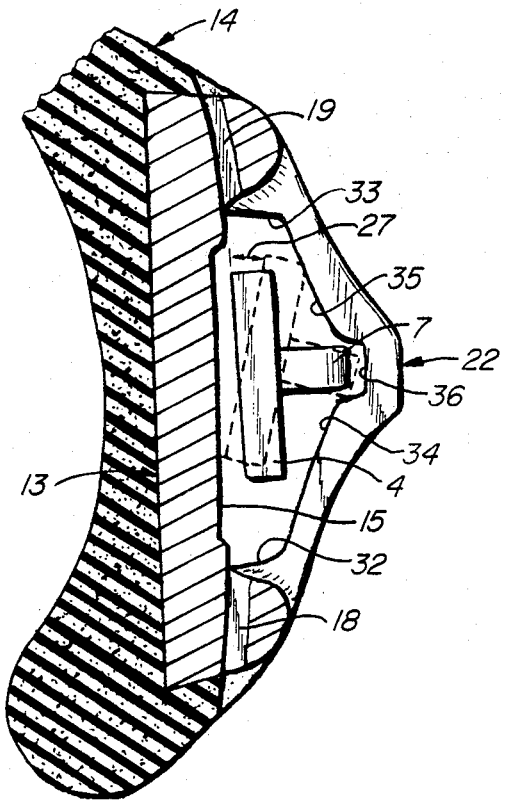
FIG. 6 is a top cross sectional view of the leg attachment member taken along line 6—6 of FIG. 4. The phantom lines show the range of axial rotational movement of the shank within the leg member socket.

Referring to FIG. 6, the structure for permitting axial rotation of the shank during forward and rearward pivotal rotation of the shank is illustrated. As shown, lower holding member 22 is formed with lower holding member portions 34 and 35 which flare outwardly from the base 15 of the socket.

Notch 36 in the lower holding member 22 permits loop 7 on the shank 4 to pass the lower holding member 22 when the shank is inserted into the socket member.

Figure 2:
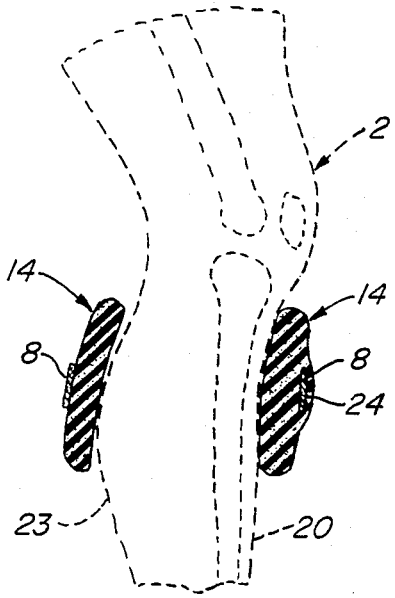
FIG. 2 is a cross sectional view of the device shown in FIG. 3 taken generally along line 2—2. A side view of the leg showing a portion of the leg bone structure is shown in phantom line.

The foam pad member 14 may be cast by standard methods to orthopedically conform to the shape of the leg bones. As shown in FIG. 2, the foam pad should be strapped to the user's leg just below the outward flare of the tibia and below the knee.

The amount of movement of the shank in lateral, axial and transverse movement should be about the same as may be obtained by moving the foot about the ankle joint when standing with the instep of the foot in the stirrup. By permitting this much freedom of movement while the workperson is standing on the stirrup, movement of the foot is transmitted to the shank which moves in the socket, but the shank does not transmit this movement to the pad or to the leg of the user. Thus, there is little or no movement between the pad and the leg of the user thus obviating chaffing.

The thick foam pad also serves to cushion the leg in sliding falls in which the workperson slides several feet before the gaffs take hold again. This type of fall can cause serious bone bruise injuries while wearing state-of-the-art climbers.

An advantage of the present climber is that the rigid socket member will accept almost all of the standard shanks. Preferably the shanks are adjustable, being constructed with an upper sleeve member 37 formed with openings 38 which register with a plurality of openings in the lower shank member 39. Appropriate bolts attach the upper sleeve to the lower shank. Thus, the length of the shank can be adjusted so that the foam pad partially encapsulates the leg at the correct location as discussed above.

To assemble the climber, the upper end 6 of the shank is inserted through the openings in the socket formed by the lower holding member 22 and then into the opening formed by the upper holding member 17. Strap 8 is then threaded through opening 18, through loop 7 in the shank, through opening 19 in the socket and then through passage 24 in the pad member. The user then places the instep of his foot on the stirrup and snaps the foam pad onto his upper leg just below the knee. Both straps 8 and 12 are buckled and the workperson is prepared for climbing a tree or pole in the usual manner by forcing the gaff 10 into the wood.

I claim:

1. A climber for a workperson comprising:

a. a stirrup member adapted for receipt of the instep of said workperson's foot;

b. a shank member connected to said stirrup member at a generally right angle having an elongated member, an upper end and a loop member attached to said upper end;

c. a gaff member connected to the lower end of said shank member adjacent said stirrup member adapted for piercing a wooden member;

d. a rigid socket member including a base member, an end member projecting from said base member, an upper holding member spaced from said base member, a pair of strap openings adapted for threadable engagement with a strap member and a lower holding member spaced from said base member;

e. a foam pad member connected to said rigid socket member, formed for partially encapsulating a portion of the inner leg of said workperson;

f. an upper leg strap member threadably inserted through said loop member on said shank member and said pair of strap openings in said socket member;

g. a foot strap member connected to said stirrup member and encircling the lower leg of said workperson; and h. said upper holding member and said lower holding member are spaced from said base member a distance greater than the thickness of said shank member permitting limited axial rotation of said shank within said socket member.

2. A climber as described in claim 1 comprising:

a. said lower holding member is spaced a greater distance from said base of said socket than said upper holding member permitting lateral pivotal displacement of said shank member about said upper shank end as a fulcrum in the plane of said stirrup member.

3. A climber as described in claim 2 comprising:

a. a pair of upper side members connected to said socket base, spaced from one another and connected to said upper holding member;

b. a pair of lower side members connected to said socket base, spaced from one another and connected to said lower holding member; and c. said lower side members are spaced a distance further apart then said upper side members permitting restricted pivotal movement of said shank member about said upper end of said shank member as a fulcrum in a plane generally at right angles to the plane of said stirrup member.

4. A climber as described in claim 1 comprising:

a. said pad member is made from closed cell polyurethane and has a thickness such that said rigid socket member edges are not transmitted to said workman under normal conditions but has sufficient resiliency to dissipate shock forces transmitted from said shank to said non-yielding socket.

5. A climber as described in claim 3 wherein:

a. said lower holding member is formed with lower holding member portions which flare outwardly from said base of said socket permitting simultaneous axial rotation and forward and rearwardly pivoting of said shank member.

* * * * *